US006501040B2

(12) United States Patent
Hall et al.

(10) Patent No.: US 6,501,040 B2
(45) Date of Patent: Dec. 31, 2002

(54) DUAL DIRECTIONAL CABLE ACTUATED EMERGENCY STOP DEVICE

(75) Inventors: Jeffrey S. Hall, Winnebago, IL (US); Mark A. Mantua, Freeport, IL (US)

(73) Assignee: Honeywell International Inc., Morristown, NJ (US)

( * ) Notice: Subject to any disclaimer, the term of this patent is extended or adjusted under 35 U.S.C. 154(b) by 54 days.

(21) Appl. No.: 09/860,984

(22) Filed: May 18, 2001

(65) Prior Publication Data

US 2002/0170811 A1 Nov. 21, 2002

(51) Int. Cl.[7] ..... H01H 15/00; H01H 17/08

(52) U.S. Cl. ..... 200/543; 200/17 R; 200/61.13; 200/52 R

(58) Field of Search ..... 200/543, 544, 200/545, 540, 334, 4, 17 R, 16 R, 43.07, 52 R, 61.13, 61.14, 61.18

(56) References Cited

U.S. PATENT DOCUMENTS

| | | | | |
|---|---|---|---|---|
| 3,939,314 A | * | 2/1976 | Loeser | 200/61.42 |
| 4,123,630 A | * | 10/1978 | Mac Intyre et al. | 200/52 R |
| 4,250,358 A | * | 2/1981 | Gilbertson | 200/52 R |
| 5,003,135 A | | 3/1991 | Piccoli | |
| 5,041,705 A | | 8/1991 | Piccoli | |
| 5,436,415 A | * | 7/1995 | Smith et al. | 200/50 C |
| 5,574,265 A | | 11/1996 | Falcon | |
| 5,665,947 A | | 9/1997 | Falcon | |
| 5,821,484 A | * | 10/1998 | Schulze et al. | 200/17 R |
| 5,821,488 A | | 10/1998 | Falcon | |
| 5,894,116 A | * | 4/1999 | Davies et al. | 200/43.04 |
| 5,896,783 A | | 4/1999 | Letzel | |
| 5,964,342 A | | 10/1999 | Wecke et al. | |
| 6,100,479 A | | 8/2000 | Fust et al. | |
| 6,156,984 A | | 12/2000 | Droessler | |
| 6,212,052 B1 | | 4/2001 | Heuer et al. | |

FOREIGN PATENT DOCUMENTS

EP 0 902 449 A1 3/1999

* cited by examiner

*Primary Examiner*—Elvin Enad
*Assistant Examiner*—Kyung Lee
(74) *Attorney, Agent, or Firm*—Kris T. Fredrick

(57) ABSTRACT

A dual directional cable actuated emergency stop device has two shaft assemblies attachable to two respective cables spanning along an industrial and/or manufacturing operation. The first shaft assembly is slideably disposed within a housing structure and movable relative to said housing structure along a first path in a direction parallel to an axial centerline of said shaft in response to a force exerted by a cable attached to an end of said first shaft. The second shaft assembly is slideably disposed within said housing structure and movable relative to said housing structure along a second path in a direction parallel to an axial centerline of said shaft and opposite movement of said first shaft, in response to a force exerted by a cable attached to an end of said second shaft. A switch operator movable along a second path between a first position and a second position is responsive to movement of said first or second shaft assemblies and is also responsive to a mechanism for locking the switch operator in a second position after said switch operator moves into a second position. At least one electrical switch associated with the device can be actuated when the switch operator is in said second position and deactuated when said switch operator is in said first position. Windows formed on the device housing cover allow a user to monitor tension of first or second cables attached to respective first and second shaft assemblies, based on the position of a cam associated with each shaft assembly.

20 Claims, 4 Drawing Sheets

DUAL DIRECTIONAL CABLE ACTUATED EMERGENCY STOP DEVICE

TECHNICAL FIELD

The present invention is generally related to cable actuated devices and, more specifically, to a dual directional cable actuated emergency device usable with manufacturing equipment and the like for improving the safety of operating the equipment.

BACKGROUND OF THE INVENTION

Many types of cable actuated switches are known to those skilled in the art. Cable actuated switches are typically used in applications where an emergency stop capability is required along an extended distance, such as assembly lines. Manufacturers, for example, typically use cable pull safety devices as a low-cost emergency stop device for long conveyor lines or large machines. In certain conveyor system applications it is often necessary to provide a means for operators to actuate the emergency stop condition from many different locations along the conveyor.

Cable activated switches that have been provided generally include a switch support body that has a bore therethrough. A first switch contact member is generally retained on the body and a second switch contact member is further slidingly retained on the body and insulated therefrom. Clamping means are typically provided for securing the cable passing through the bore. First resilient mechanisms are also provided to bias electrical or manual contact members. During operation, or reaction to a safety hazard, first and second contact members are displaced relative to each other by predetermined axial movement of the cable that passes through the support body. The result is generally the emergency termination of industrial or manufacturing mechanical processes.

Cable controlled electrical safety switch devices have also been provided that include a piston tensioning cable under the action of a spring via a rod and a screw thread for adjusting the tension of the spring and of the cable. A piston groove actuates a push member for the switch. The piston can be angularly adjustable. When the cable is long, a high tension is selected so the groove flank moves away from the push member. Distancing is desirable in such systems in order that any length variations due to heat, which are greater with a long cable, may be prevented from triggering the switch. The clearance between the other flank and the push member is then corrected by rotation of the piston.

Because electrical switches for preventing an accident in a mechanism employing a control cable can generally be included in a casing having a pair of contacts at opposite inner side surfaces thereof and an insulator member having a movable contact, an insulation member may be configured such that it is slideably and axially moved within the casing in connection with tensile force of inner cables. When the inner cables become inoperable because of some problem, the movable contact is touched to the contacts provided on the inner side surfaces of the casing in order to detect the problem or to stop the movement of the mechanism.

U.S. Pat. No. 5,665,947, which issued to Falcon on Sep. 9, 1997, and is owned by the assignee of the present invention, describes a cable switch actuating mechanism, which is provided with a shaft, and a cam structure that slides on the shaft. When the associated cable is pulled to exert an axial force on the shaft, the cam actuator is pushed by the shaft into a deactuating position that moves a switch operator plunger against a plunger of an associated electrical switch. If the cable breaks, the reduction of force on the shaft allows an internal spring to move the shaft against the cam structure and, as a result, move the switch operator into its deactuating position. Appropriate gaps between the opposite ends of the cam structure and associated surfaces of the shaft were provided by design to allow for thermal expansion and contraction of the cable without adverse affects on the mechanism.

U.S. Pat. No. 5,821,488, which issued Oct. 13, 1998, is an improvement over the cable operated switching mechanism described in the '947 patent described above and is also assigned to the assignee of record for the present invention. The improvement is the provision of a latch device associated with a reset plunger which is movable between a normal operating position and a resetting position, wherein the cam structure is moved by the reset plunger to unlock the switch operator when the reset plunger is moved to the resetting position. The positive locking method of the cable operated switching mechanism latches a cam structure in place after the cable is pulled by an operator and does not permit the cam structure to return to its normal operating position until manual intervention is used to push a reset plunger. The cable operated switching mechanism provided a positive stop by incorporating a tab on a latching device, which is associated with the reset plunger and moves with it when a reset button is pushed. The tab of the latching device slides along a first surface of the cam structure until the cable is pulled to activate the mechanism. Then, under the influence of a spring, the latching device moves upward to cause the tab to move into a blocking position relative to a second surface of the cam structure. The tab prevents the cam structure from moving from its actuated position to its normal operating position until a reset button is pushed. This mechanism overcomes a possible problem wherein a loosely assembled cable, with too much slack, could otherwise allow a switch to be activated by the mechanism, following deactivation by an operator pulling the cable.

When long cable lengths are used in association with a cable actuated switch, changes in temperature can activate or deactivate the switch because of the resultant changes in the length of the cable as a result of the cable's thermal coefficient of expansion. With regard to the expansion or contraction of the cable as a result of temperature change, it is much more common for most cables to experience high temperatures during extended use than when the cable was initially installed. In some environments, opposite extreme conditions may exists (e.g., lower temperatures than experienced during initial installation). This occurs because many applications of cable-actuated switches are used in circumstances, such as warehouses, where there may be large variation in temperature that affect the cables characteristics. Furthermore, heating or air conditioning may or may not be provided for winter or summer conditions in such environments. As a result, heating systems are able to maintain the apparatus at normal operating temperatures during winter months, but no air conditioning systems are provided to maintain the apparatus at normal operating temperatures during summer months. As a result, the cables can expand beyond their normal lengths during summer months.

Rather than provide numerous emergency stop switches at multiple locations along the equipment, it is sometimes deemed economically advantageous to provide a single switch that can be actuated by pulling a cable that may extend along, for example, a conveyor system from the switch to a remote location. Although the majority of cable pull devices are single direction units capable of spans up to around 200 feet, some dual directional units do exist, which in effect double the span to around 400 feet. With such long spans of cabling, malfunctions and/or false activations can be prevalent. For example, teasing of the device is found where electrical trip happens prior to mechanical trip. In a teased condition, the normally closed contacts would be open, but the normally open contacts would remain open. The normally closed contacts typically shut down the machine, and the normally open contacts typically signal (e.g., light, etc.) that the device was tripped. Therefore, if the device is teased, the machine could shut down without any indication of the source. On long conveyor lines or large machines, this situation is costly and frustrating.

Another problem with prior art devices is the difficulty associated with their set up. For example, to reset (e.g., place in run mode) a cable pull device, the cable must be set to a proper tension. Determining proper cable tension for accurate operation can be difficult. It may also be difficult to determine if the system or device is in the proper run or off state.

The present invention recognizes that It would be advantageous to remedy the foregoing and other deficiencies in the prior art and to facilitate the safe employment of manufacturing equipment, or the like. There is a continued need for improvement in safety mechanisms used, for example, with high-speed industrial equipment that is subject to forces that can cause an interruption in the proper operation of the equipment and can result in damage to persons and/or the equipment if the operation is not terminated in a safe manner.

Accordingly, the present invention is described and presented as a novel means to address the shortcomings of the prior art.

SUMMARY OF THE INVENTION

The following summary of the invention is provided to facilitate an understanding of some of the innovative features unique to the present invention, and is not intended to be a full description. A full appreciation of the various aspects of the invention can be gained by taking the entire specification, claims, drawings, and abstract as a whole. Additional objects and advantages of the current invention will become apparent to one of ordinary skill in the art upon reading the specification.

In accordance with addressing the limitations of the prior art, now presented are features of the present invention capable of providing a new and improved cable actuated emergency stop device.

It is a feature of the present invention to provide dual directional cable pull devices that provide end users with an essential part of a cost-effective, simple to set up safety system.

It is another feature of the present invention to provide a dual directional cable pull devices that provide diagnostics.

In accordance with the present invention, a dual directional device is described that has two operating shafts exiting each side of a housing, allowing one device to be mounted at mid-span of the a long cable run where typically two or more devices would be required, thus resulting in a cost effective solution to long span applications.

In accordance with another feature of the present invention, the device includes windows on the housing cover providing a view of two indicators that indicate if actuating cables extending from the operating shaft assembly extending from each side of the device are set at the proper tension or if either cable needs to be adjusted (tightened or loosened).

In accordance with another feature of the present invention, diagnostics are provided by mechanical trip indication upon manual reset, so the user can easily and visually tell if the device is off or in an operable position.

In accordance with another feature of the present invention, the device provides pulled cable and slacken/broken cable detection.

In accordance with another feature of the present invention, the device further includes a snap-action mechanism that prevents teasing of electrical switches (electrical trip prior to mechanical trip) in either pulled or slackened/broken cable scenarios.

In accordance with another feature of the present invention, the device latches in both pulled or slackened/broken cable and remains latched until the reset is rotated or otherwise engaged.

In accordance with the present invention, a dual directional cable actuated emergency stop device is provided having two shaft assemblies attachable to at least two respective cables spanning along an industrial and/or manufacturing operation. The first shaft assembly is slideably disposed within a housing structure and movable relative to said housing structure along a first path in a direction parallel to an axial centerline of said shaft in response to a force exerted by a cable attached to an end of said first shaft. The second shaft assembly is slideably disposed within said housing structure and movable relative to said housing structure along a second path in a direction parallel to an axial centerline of said shaft, and opposite movement of said first shaft, in response to a force exerted by a cable attached to an end of said first shaft. A switch operator movable along a second path between a first position and a second position is responsive to movement of said first or second shaft assemblies and is also responsive to a mechanism for locking the switch operator in a second position after said switch operator moves into a second position. At least one electrical switch associated with the device can be actuated when the switch operator is in said second position and deactuated when said switch operator is in said first position. Windows formed on the device housing cover allow a user to monitor tension of first or second cables attached to respective first and second shaft assemblies, based on the position of a cam associated with each shaft assembly.

BRIEF DESCRIPTION OF THE DRAWINGS

The accompanying figures, in which like reference numerals refer to identical or functionally-similar elements throughout the separate views and which are incorporated in and from part of the specification, further illustrate the present invention and, together with the detailed description of the invention, serve to explain the principles of the present invention.

DETAILED DESCRIPTION OF THE INVENTION

The novel features of the present invention will become apparent to those of skill in the art upon examination of the following detailed description of the invention or can be learned by practice of the present invention. It should be understood, however, that the detailed description of the invention and the specific examples presented, while indicating certain embodiments of the present invention, are provided for illustration purposes only because various changes and modifications within the scope of the invention will become apparent to those of skill in the art from the detailed description of the invention and claims that follow.

Figure 1:
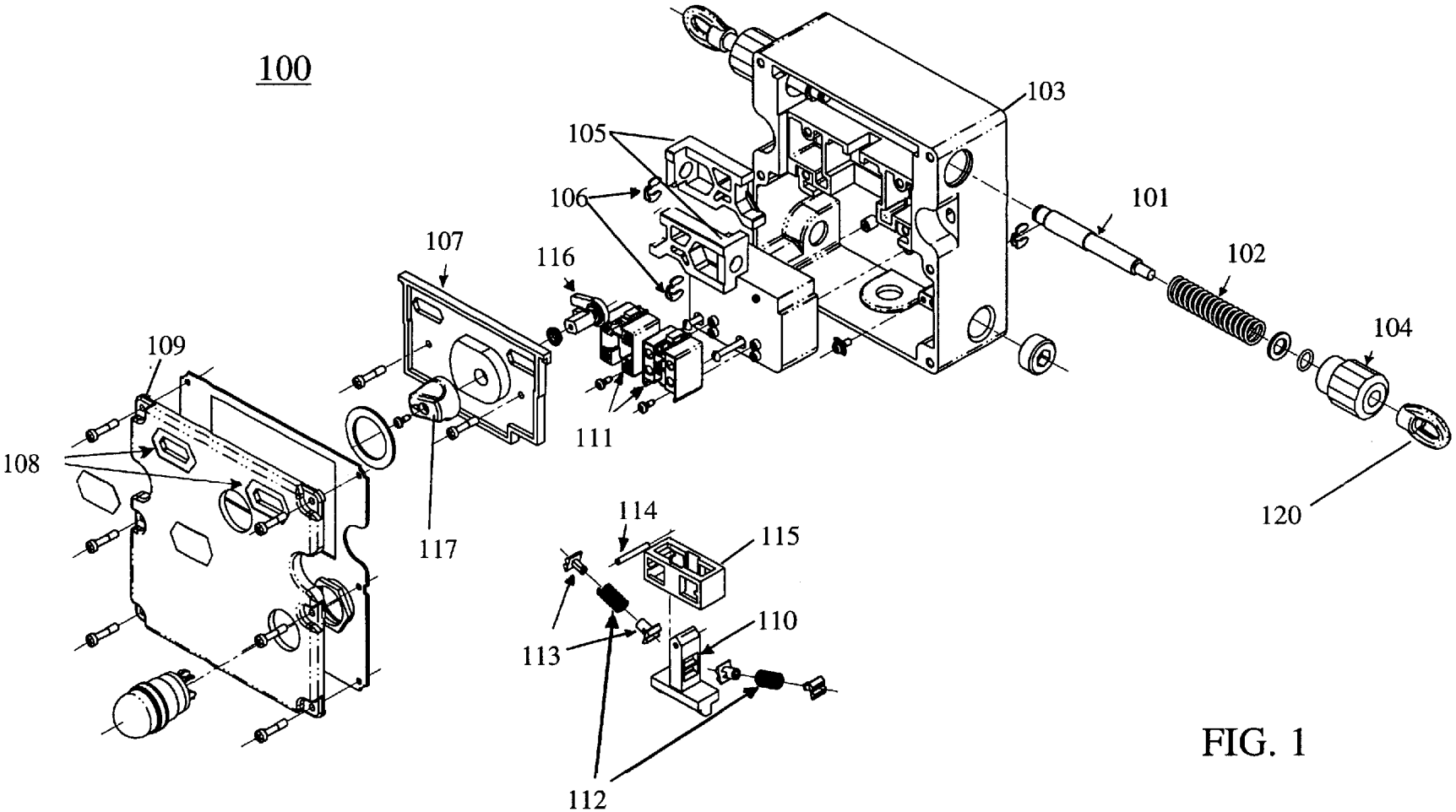
FIG. 1 is a perspective view of an unassembled dual directional cable actuated emergency stop device in accordance with a preferred embodiment of the present invention.

Referring to FIG. 1, a perspective view of an unassembled dual directional cable actuated emergency stop device 100 in accordance with a preferred embodiment of the present invention is illustrated. Cams 105 provide tensioning indication through windows 108 formed on the cover 109. Return springs 102 apply a force to cams 105 and shafts 101, forcing them toward the center of the device 100. If the actuating cable (not shown) becomes loose, the return springs 102 apply a force to cams 105, moving the cam's position, which is viewed through the windows 108 of the cover 109, indicating that either or both of the actuating cables needs adjustment. If an actuating cable is too tight (e.g., during set up or due to change in temperature), a position of cam 105, viewed through the cover 109, moves, indicating that the actuating cable needs adjustment.

The two cams 105, when at proper tension, are located so that their cam profiles are on top of each other. The cam profiles actuate a common plunger 110 that in turn operates the basic switches 111. The "snap action" is obtained by the plunger 110 and associated parts (112–114), also referred to in combination herein as a single plunger mechanism. The snap action plunger mechanism is an over-center type of mechanism. It is comprised of a plunger, anchor 115, and a set of compression springs 112 assembled to pivot shafts 113. One end of pivot shafts 113 pivots on the plunger 110. The opposite end of the pivot shafts would pivot on the anchor. It should be appreciated that springs may be replaced by other parts having compressive or elastic characteristics for providing spring-like force against or for the cams 105, pivot shafts 113 and plunger 110.

The entire plunger mechanism fits into a pocket in the housing and is retained by the internal cover 107. The plunger 110 has a pin 114 that allows a fork-shaped cam 116, attached to the reset knob 117 on the cover, to reset the plunger mechanism. The reset knob 117 also functions as a mechanical indication of trip. When the plunger 110 is up, the reset knob 117 is in a position that indicates run status by pointing to the word "RUN" on the cover 109 label. When plunger 110 is down, the reset knob would be rotated to a position that indicates trip by pointing to the word "OFF" on the cover label. The reset knob 117 is located on the housing subassembly, so that the cover can be assembled to the housing without lining up anything.

Cables (not shown) are attachable to each shaft assembly (i.e., elements 101, 102, 104) by a metal loop 120, thimble, or other receiving mechanism known in the art. The cables are then tightened until the cams 105 are centered in their respective cover windows 108 for each cable end. At proper tension, the plunger 110 can be moved into the run position by rotating the reset knob 117.

Operating shafts 101 and return springs 102 can be retained to a zinc die-cast housing 103 using threaded brass bushings 104. A plastic cam 105 is insertable onto each shaft 101 (shaft 101 is received through a slot in cam 105), and retainable by retaining rings 106. The cams 105 can be fixed to the end of the shafts 101 and can be restrained from rotating by the housing 103 and an internal cover 107. Therefore, the operating shafts 101 can rotate without affecting the cam 105.

Figure 2B:
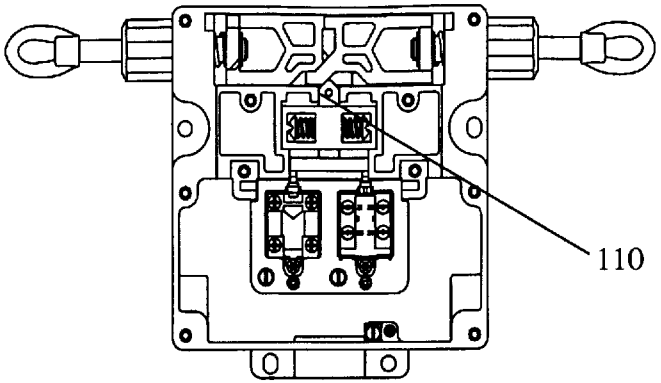
FIG. 2B is a frontal plan view of the device of FIG. 1 illustrating the cams and plunger at a point of snap-over.
Figure 2D:
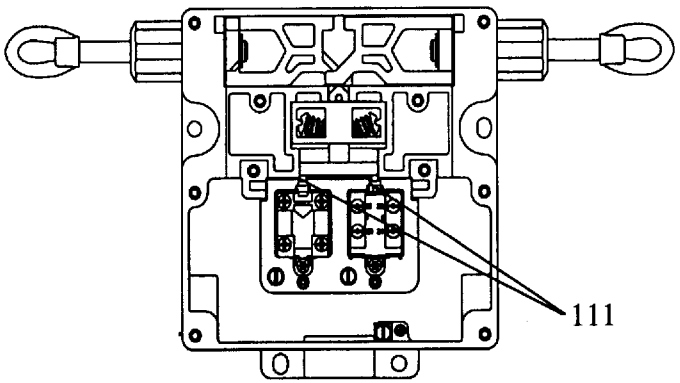
FIG. 2D is a frontal plan view of the device of FIG. 1 illustrating the cams at full actuation.
Figure 2A:
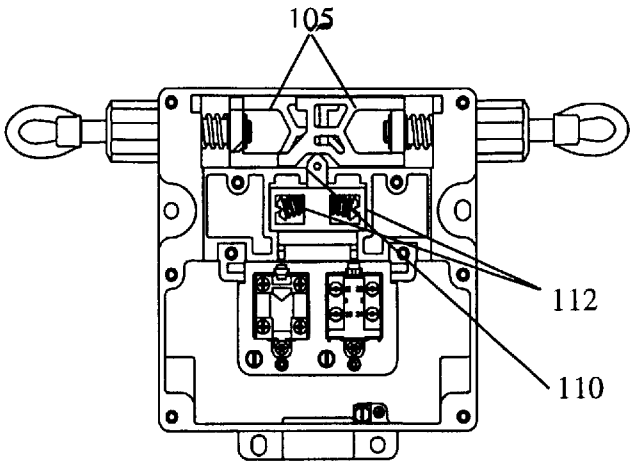
FIG. 2A is a frontal plan view of the device of FIG. 1 illustrating cams at proper tension and the plunger in the RUN position.

Referring to FIG. 2A, during operation the plunger 110 is maintained in the run position by the two pivot springs 112 of the plunger mechanism. When either of the cables (not shown) are pulled, either of the cams 105 moves the plunger down. When either of the cables breaks or becomes slack, the springs 102 push the respective cam 105, which in turn moves the plunger 110 down. In either case, as the cam 105 and plunger 110 move, the pivot springs 112 on the plunger move.

Figure 2C:
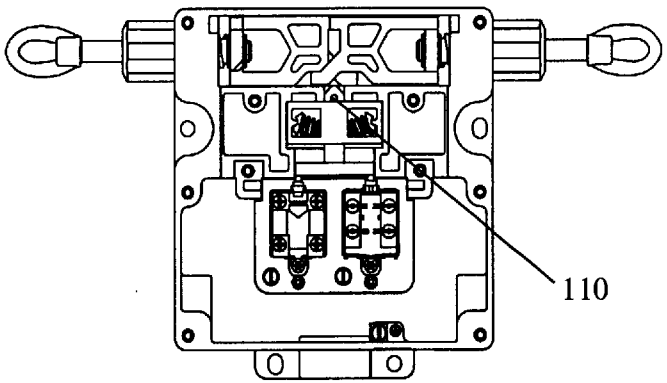
FIG. 2C is a frontal plan view of the device of FIG. 1 illustrating the cams at point of snap-over, plunger at full actuation.

After the pivot point of the plunger 110 passes the pivot point on the anchor, as shown in FIG. 2B, the spring force pushes the anchor 115 up and the plunger 110 down independent of the shaft movement, as shown at FIG. 2C. The plunger 110 then actuates the switches 111, as shown in FIG. 2D.

The use of the anchor improves snap-over by ensuring the springs are at an angle producing vertical forces at the plunger. The plunger is maintained in this final position by the two pivot springs. As the shaft continues to move, the plunger is mechanically driven by the cam to ensure positive break of the normally closed contacts occurs.

Figures 3A, 3B, 3C:
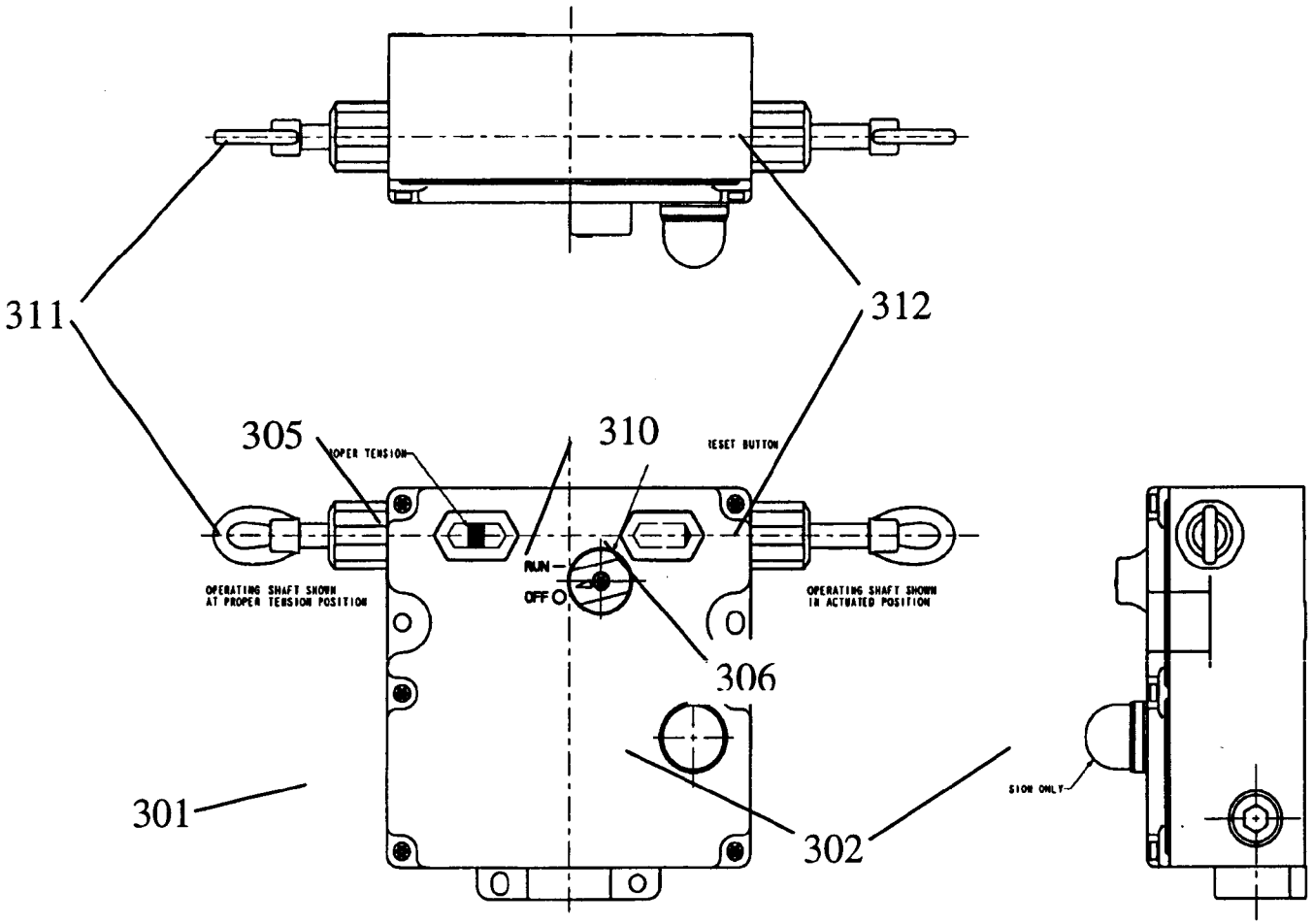
FIG. 3A is a frontal plan view of the device of FIG. 1 illustrating proper tension with a first cable and improper tension (shown at actuated position) on a second cable.
FIG. 3B is a side view of the device of FIG. 1.
FIG. 3C is a top view of the device of FIG. 1.

Referring to FIG. 3, a front plan view of the present invention is shown. On the front cover 301 of the device is an emergency indicator 302, which may be in the form of a light. The tension indicator window 305 on the left side of the device is shown to be set at the proper tension for the left operating shaft. Proper tension is indicated by where the indicator is centered in the window. The tension indicator window 306 on the right side of the drawing shows the cam associated with the cable on the right of the device to be improperly centered, and therefore could cause the device to be in alarm. A technician or operator, given this scenario would adjust the tension of the cable attached to the shaft assembly on the right side of the device and then would manually reset the device with the manual reset button 310 by placing it in the "Run" position. Referring to FIG. 3B, a side view of the device is shown.

Figure 4:
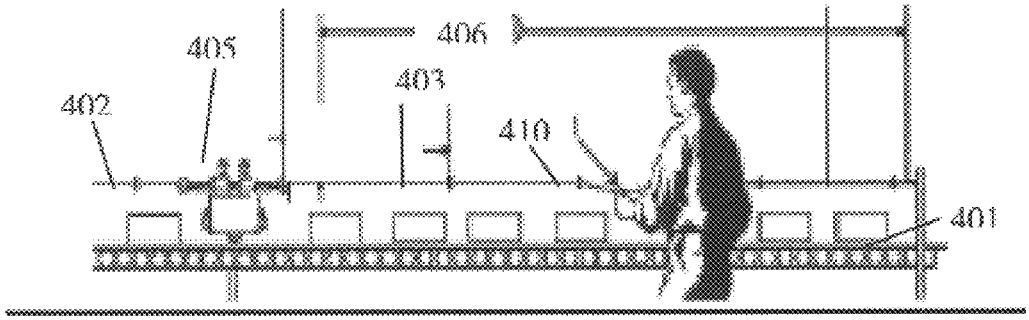
FIG. 4 is an illustration of an environment wherein the dual directional cable actuated emergency stop device of the present invention is implemented.

Referring to FIG. 4, an example of an manufacturing environment where the device would be used in illustrated. The figure shows a conveyor system 401 as part of an assembly line. The device 405 is secured in its placement between two cables 402, 403. The cables 402, 403 are within reach of the operator 410 so that an emergency may be indicated by the manual placement of tension on the cables. Tension can occur purposely where the operator had manually placed pressure on the cable or where the operator had become placed dangerously into interference with the conveyance system. The benefit of using the dual cable device of the present invention is apparent given the present teachings and illustration, especially for lengthy industrial application such as the illustrated conveyor line 401 of FIG. 4. For example, the span of cable indicated by reference 406 in FIG. 4, that can be used with the present invention, can easily meet all manufacturing and industrial requirements with spans reaching 100 ft or more. It should also be appreciated given the teachings herein, that other members extending from the device may be used to interrupt operation. For example, string, rope, wire, threaded screws or fasteners, elongated members such as poles (plastic, metal, wood), or a combination of any of the above materials including mesh or net material. These materials are known to be accessible to operators at production sites and can be used to interfere with operations when actuated by physical disturbance by personnel. Therefore, "cable" is broadly defined as including all the aforementioned examples.

Figure 5:
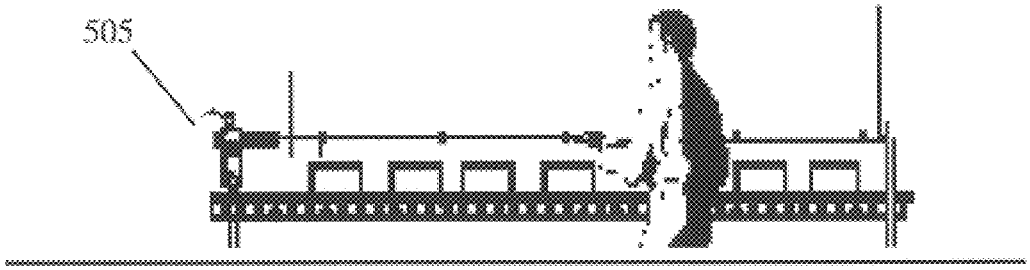
FIG. 5 (Prior Art)
FIG. 5 is an illustration of an environment wherein a single cable device, similar to those taught in the prior art, is used.

Referring to FIG. 5 (labeled as Prior Art) an example illustration of the same environment is shown where only a single action device 505, as currently provided in the art, is used. Before the present invention, at least two devices would have to be installed, back to back, in order to accomplish what is achievable with the present invention.

The embodiment and examples set forth herein are presented to best explain the present invention and its practical application and to thereby enable those skilled in the art to make and utilize the invention. Those skilled in the art, however, will recognize that the foregoing description and examples have been presented for the purpose of illustration and example only. Other variations and modifications of the present invention will be apparent to those of skill in the art, and it is the intent of the appended claims that such variations and modifications be covered. The description as set forth is not intended to be exhaustive nor to limit the scope of the invention. Many modifications and variations are possible in light of the above teaching without departing from the spirit and scope of the following claims. It is contemplated that the use of the present invention can involve components having different characteristics. It is intended that the scope of the present invention be defined by the claims appended hereto, giving full cognizance to equivalents in all respects.

The embodiments of an invention in which an exclusive property or right is claimed are defined as follows:

1. A cable actuated emergency stop system comprising:

a housing structure;

a first shaft slideably disposed within said housing structure, said first shaft being movable relative to said housing structure along a first path in a direction substantially parallel to an axial centerline of said first shaft in response to a first force exerted by at least one first cable attached to an end of said first shaft;

a second shaft slideably disposed within said housing structure, said second shaft being movable relative to said housing structure along a second path in a direction substantially parallel to an axial centerline of said second shaft, and opposite movement of said first shaft, in response to a second force exerted by at least one second cable attached to an end of said second shaft;

a first cam structure having a first opening formed therethrough, said first opening being shaped to receive said first shaft therein in slideable relation with said first cam structure;

a second cam structure having a second opening formed therethrough, said second opening being shaped to receive said second shaft therein in slideable relation with said second cam structure;

a switch operator that is movable along a second path between at least a first position and a second position in response to movement of said first or second cam structure in either a first direction or a second direction substantially parallel to said first or second path; and mechanism for locking said switch operator in said second position after said switch operator moves into said second position.

2. The mechanism of claim 1, further comprising;

at least one electrical switch associated with said housing structure, said at least one electrical switch being actuated when said switch operator is in said second position and deactuated when said switch operator is in said first position.

3. The mechanism of claim 1, further comprising:

first mechanism for moving said first or second cam structure in said first direction in order to move said switch operator into said second position in response to said first force increasing beyond a first threshold magnitude; and second mechanism for moving said first or second cam structure in said second direction in order to move said switch operator into said second position in response to said second force decreasing beyond a second threshold magnitude.

4. The mechanism of claim 3, wherein:

said first moving mechanism comprises an enlarged portion of said first shaft that is shaped to urge said first cam structure in said first direction in response to movement of said first or second shaft in said first direction.

5. The mechanism of claim 3, wherein:

said second moving mechanism comprises an enlarged portion of said second shaft that is shaped to urge said second cam structure in said second direction in response to movement of said second shaft in said second direction.

6. The mechanism of claim 3, wherein:

said second moving mechanism comprises a second enlarged portion of said first and second shaft that is shaped to urge said first or second cam structure in said second direction in response to movement of said first or second shaft in said first or second direction, respectively.

7. The mechanism of claim 6, wherein:

said second moving mechanism further comprises at least one spring for urging said first or second shaft in said second direction in response to said second force decreasing beyond said second threshold magnitude.

8. The mechanism of claim 1, further comprising:

mechanism for resetting said mechanism by urging said first or second cam structure in said first direction in order to move said switch operator from said second position to said first or second position, respectively.

9. The mechanism of claim 1, wherein:

said first path is substantially perpendicular to said second path.

10. A dual directional cable actuated emergency stop device, comprising:

a housing structure;

a first shaft assembly slideably disposed within said housing structure, said first shaft assembly being movable relative to said housing structure along a first path in a direction substantially parallel to an axial centerline of said first shaft in response to a first force exerted by at least one first cable attached to an end of said first shaft assembly;

a second shaft assembly slideably disposed within said housing structure, said second shaft assembly being movable relative to said housing structure along a second path in a direction substantially parallel to an axial centerline of said second shaft assembly, and opposite movement of said first shaft assembly, in response to a second force exerted by at least one second cable attached to an end of said second shaft assembly;

a switch operator that is movable along a third path between a first position and a second position in response to movement of said first and/or second shaft assembly in either a first direction or a second direction substantially parallel to said first path;

mechanism for locking said switch operator in said second position after said switch operator moves into said second position; and at least one electrical switch attached to said housing structure, said at least one electrical switch being actuated when said switch operator is in said second position and deactuated when said switch operator is in said first position.

11. The mechanism of claim 10, further comprising:

a first cam structure having first opening formed therethrough, said first opening being shaped to receive said first shaft therein in slideable relation with said first cam structure;

a second cam structure having second opening formed therethrough, said second opening being shaped to receive said second shaft therein in slideable relation with said second cam structure;

first mechanism for moving said first cam structure in said first direction in order to move said switch operator into said second position in response to said first force increasing beyond a first threshold magnitude; and second mechanism for moving said second cam structure in said second direction in order to move said switch operator into said second position in response to said second force decreasing beyond a second threshold magnitude.

12. The mechanism of claim 11, wherein:

said first moving mechanism comprises a first enlarged portion of said first shaft that is shaped to urge said first cam structure in said first direction in response to movement of said first shaft in said first direction.

13. The mechanism of claim 11, wherein:

said second moving mechanism comprises a second enlarged portion of said second shaft that is shaped to urge said second cam structure in said second direction in response to movement of said second shaft in said second direction.

14. The mechanism of claim 13, wherein:

said second moving mechanism further comprises at least one spring for pushing said second shaft in said second direction in response to said second force decreasing beyond said second threshold magnitude.

15. The mechanism of claim 10, further comprising:

mechanism for resetting said mechanism for locking by urging said first or second cam structure in said first direction in order to move said switch operator from said second position to said first position.

16. The mechanism of claim 11, wherein:

said first path is substantially perpendicular to said second path.

17. The mechanism of claim 11, wherein:

said switch operator comprises a cam follower disposed in contact with said first or second cam structure.

18. The mechanism of claim 11, further comprising:

a cover having formed thereon a first indicator window and a second indicator window, said first indicator window providing a view of said first cam structure and said second window providing a view of said second cam structure.

19. A cable actuated safety device, comprising:

a housing structure including a cover having formed thereon a first indicator window and a second indicator window, said first indicator window for providing a user view of a first cam and said second window providing a user view of a second cam;

a first shaft assembly slideably disposed within said housing structure, said first shaft assembly being movable relative to said housing structure along a first path in a direction substantially parallel to an axial centerline of said first shaft assembly in response to a first force exerted by a first cable attached to an end of said first shaft assembly;

a first cam structure having a first opening formed therethrough, said first opening being shaped to receive said first shaft assembly therein in slideable relation with said first cam structure;

a second shaft assembly slideably disposed within said housing structure, said second shaft assembly being movable relative to said housing structure along a second path in a direction substantially parallel to an axial centerline of said second shaft assembly in response to a second force exerted by a second cable attached to an end of said second shaft assembly;

a second cam structure having a second opening formed therethrough, said second opening being shaped to receive said second shaft assembly therein in slideable relation with said second cam structure;

a switch operator that is movable along a third path between a first position and a second position in response to movement of said first or second cam structure in either a first direction or a second direction;

mechanism for locking said switch operator in said second position after said switch operator moves into said second position;

at least one electrical switch attached to said housing structure, said at least one electrical switch being actuated when said switch operator is in said second position and deactuated when said switch operator is in said first position;

first mechanism for moving said first cam structure in said first direction in order to move said switch operator into said second position in response to said first force increasing beyond a first threshold magnitude; and second mechanism for moving said second cam structure in said second direction in order to move said switch operator into said second position in response to said second force decreasing beyond a second threshold magnitude;

wherein said first mechanism comprises a first enlarged portion of a first shaft that is shaped to urge said first cam structure in said first direction in response to movement of said first shaft assembly in said first direction, said second mechanism comprises a second enlarged portion of a second shaft that is shaped to urge said second cam structure in said second direction in response to movement of said second shaft assembly in said second direction.

20. The device of claim 19 further comprising mechanism for resetting said mechanism for locking by urging said first or second cam structure in said first or second direction in order to move said switch operator from said second position to said first position, said first path being substantially perpendicular to said second path, said switch operator comprising a cam follower disposed in contact with said first or second cam structure.

* * * * *